US007547203B2

(12) United States Patent
Dieterich

(10) Patent No.: US 7,547,203 B2
(45) Date of Patent: Jun. 16, 2009

(54) SCREW COMPRESSOR

(75) Inventor: Rolf Dieterich, Horb (DE)

(73) Assignee: Bitzer Kuehlmaschinenbau GmbH (DE)

( * ) Notice: Subject to any disclaimer, the term of this patent is extended or adjusted under 35 U.S.C. 154(b) by 21 days.

(21) Appl. No.: 11/292,593

(22) Filed: Dec. 2, 2005

(65) Prior Publication Data

US 2006/0117790 A1 Jun. 8, 2006

(30) Foreign Application Priority Data

Dec. 2, 2004 (DE) ..... 10 2004 060 596

(51) Int. Cl.
*F01C 1/16* (2006.01)
*F01C 21/04* (2006.01)
*F04C 15/00* (2006.01)
*F04C 29/02* (2006.01)

(52) U.S. Cl. ..... 418/201.2; 418/270; 418/97; 418/2; 418/87; 418/89; 418/DIG. 1

(58) Field of Classification Search ..... 418/201.1, 418/201.2, 270, 97, 99, 2, 89, DIG. 1, 87
See application file for complete search history.

(56) References Cited

U.S. PATENT DOCUMENTS 3,191,854 A * 6/1965 Lowler et al. ..... 418/85
3,905,729 A * 9/1975 Bauer ..... 418/84
RE29,283 E * 6/1977 Shaw ..... 417/282
4,336,001 A * 6/1982 Andrew et al. ..... 417/63
4,609,329 A * 9/1986 Pillis et al. ..... 417/282
4,799,865 A * 1/1989 Oscarsson ..... 417/283
5,018,948 A * 5/1991 Sjte et al. ..... 417/302
5,044,894 A * 9/1991 Field et al. ..... 417/310
5,236,320 A * 8/1993 Oishi et al. ..... 418/84
5,341,658 A * 8/1994 Roach et al. ..... 62/468
5,642,989 A * 7/1997 Keddie ..... 417/298
5,713,724 A * 2/1998 Centers et al. ..... 417/53
5,884,494 A * 3/1999 Okoren et al. ..... 62/126
6,139,280 A * 10/2000 Holt et al. ..... 417/26
6,666,661 B2 12/2003 Dieterich
7,204,678 B2 * 4/2007 Truyens et al. ..... 418/84
2001/0046443 A1 11/2001 Van De Putte

* cited by examiner

*Primary Examiner*—Thomas E Denion
*Assistant Examiner*—Mary A Davis
(74) *Attorney, Agent, or Firm*—Reinhart Boerner Van Deuren P.C.

(57) ABSTRACT

In order to improve a screw compressor for compressing refrigerant in a refrigerant circuit, comprising a compressor housing, in which a screw rotor receiving means and an inlet channel as well as an outlet channel for the refrigerant to be compressed are provided, at least one screw rotor arranged in the screw rotor receiving means, a drive for the at least one screw rotor and a lubricant supply which conveys lubricant from a lubricant reservoir acted upon by pressure via a line system at least to the at least one screw rotor during operation, in such a manner that the operation and the monitoring of the screw compressor are reliable it is suggested that a valve be provided in the line system of the lubricant supply, this valve being controllable by way of a difference in pressure between the pressure in the outlet channel and a reference pressure influenced by a pressure in the refrigerant circuit and opening when the screw rotor is compressing refrigerant as well as closing when the screw rotor is not compressing refrigerant.

9 Claims, 7 Drawing Sheets

12
40
42
44
48
50
52
54
56
58
60
62
70
82
84
86
88
90
150

12
14
16
18
20
30
32
34
36
40
42
46
48
62
70
72
74
80
82
86
88
90
92
102
104
108
112
114
116
118
130
132
140
150
154
160
162
P1
P2
P3
P4

44
46
102
72
98
100
94
118
104
112
106
108
114
136
92
134
132
72
120
110
116
74
80
154
150
96
86
84
88
90
73
40
72

44
46
102
112
98
108
114
136
130
72
P3
90
132
134
110
120
80
P1
160
158
154
152
P4
150
156
P1
P4

P2
92
114
112
P1
108
102
110
94
104
162
164
156
P1
166
152
154
P4
158
P3
72
44
46
90
88
86
84
P4

44
46
72
72
136
106
71
112
98
102
92
72
90
73
132
134
164
94
104
71
84
88
86
74
166
150
162
154
74

SCREW COMPRESSOR

This patent application claims the benefit of German Application No. 10 2004 060 596.3, filed Dec. 2, 2004, the teachings and disclosure of which are hereby incorporated in its entirety by reference thereto.

BACKGROUND OF THE INVENTION

The invention relates to a screw compressor for compressing refrigerant in a refrigerant circuit, comprising a compressor housing, in which a screw rotor receiving means and an inlet channel as well as an outlet channel for the refrigerant to be compressed are provided, at least one screw rotor arranged in the screw rotor receiving means, a drive for the at least one screw rotor and a lubricant supply which conveys lubricant from a lubricant reservoir acted upon by pressure via a line system at least to the at least one screw compressor during operation.

Screw compressors of this type are known from the state of the art but the problem with them is that when the screw compressors are switched off there is often the risk of lubricant continuing to run in them and, therefore, of this lubricant collecting in the screw rotor receiving means in the area of the screw rotors and, as a result, leading to problems when the screw rotors are started up. For this reason, an external magnetic valve and an external flow monitor are provided in the lubricant supply and these devices prevent any excessive supply of lubricant, in particular, during stoppage of the screw compressor. They do, however, have the disadvantage that their operational functioning is not reliable.

The object underlying the invention is, therefore, to improve a screw compressor of the generic type in such a manner that the operation and the monitoring of the screw compressor are more reliable.

SUMMARY OF THE INVENTION

This object is accomplished in accordance with the invention, in a screw compressor of the type described at the outset, in that a valve is provided in the line system of the lubricant supply and this valve can be controlled by way of a difference in pressure between the pressure in the outlet channel and a reference pressure influenced by a pressure in the refrigerant circuit and opens when the screw rotor is compressing refrigerant as well as closes when the screw rotor is not compressing refrigerant.

The advantage of this solution is to be seen in the fact that, with it, it is possible to provide or to interrupt the supply of lubricant in direct correlation to the compression of the refrigerant by the screw rotor.

In addition, an essential advantage of this solution according to the invention is to be seen in the fact that the valve does not operate on the basis of an absolute pressure but rather a difference in pressure is created between the pressure in the outlet channel, i.e., the pressure of the compressed refrigerant and a reference pressure which is influenced by a pressure in the refrigerant circuit. This means that, as a result, it is possible to detect a faultless functioning of the screw rotors independently of the absolute level of pressure, at which the screw compressor and the refrigerant circuit operate.

In principle, the reference pressure may be influenced by any optional pressure in the refrigerant circuit.

A particularly simple solution provides for the reference pressure to be influenced by a pressure in the high pressure section of the refrigerant circuit and so the reference pressure already has a level of pressure which does not differ to any great extent from the level of pressure of the compressed refrigerant in the outlet channel. As a result, the control of the valve can be configured in a particularly simple manner.

It is particularly advantageous when the reference pressure is derived from a pressure in the high pressure section of the refrigerant circuit, i.e., is preferably essentially proportional to the pressure in the high pressure section of the refrigerant circuit.

In principle, it would be conceivable to provide a line, via which the pressure in the high pressure section of the refrigerant circuit is conveyed to the valve for determining the difference in pressure.

A particularly simple solution does, however, provide for the reference pressure to be influenced by the pressure in the refrigerant circuit which acts on the lubricant reservoir and is transferred by the lubricant supply.

The valve may be designed in a particularly simple manner when the valve can be controlled by a piston which is acted upon, on the one hand, by refrigerant subject to the pressure in the outlet channel and, on the other hand, by the reference pressure.

This may be realized in a particularly advantageous manner in that the piston of the valve can be acted upon by lubricant coming from the lubricant reservoir on the side provided for the action of the reference pressure and can be moved in the direction of its closing position.

This means that the lubricant coming from the lubricant reservoir moves the piston into its closing position insofar as the pressure of the compressed refrigerant in the outlet channel is lower than the reference pressure.

In order to keep the valve, which has been closed by the piston moved into a closing position, in the closed position, the valve is preferably designed such that it has a valve assembly which comprises a valve seat and a valve member and which is designed such that the pressure of the lubricant acting on the valve member when the valve member is seated on the valve seat results in a force in the direction of the closed position of the valve member.

Furthermore, it is favorable when the valve member is acted upon by an elastic force storing member, for example, a spring which transfers the valve into its closed position and keeps it in this position in the case of a balance of pressure at the piston.

In order to be able to install the screw compressor where possible as a unit in the respective refrigerant circuit, it is preferably provided for the valve to be integrated in the compressor housing of the screw compressor.

As a result, complicated installations in the lubricant line to the compressor are, in particular, no longer necessary.

Furthermore, a lubricant filter is preferably arranged in the line system for the lubricant for the preparation of the lubricant.

The lubricant filter is also preferably integrated into the compressor housing of the screw compressor in order to obtain a compact unit.

In addition or alternatively to the invention described thus far, it is provided in accordance with the invention, in the case of a screw compressor of the type described at the outset, for this to comprise a first differential pressure detection element which detects a difference in pressure between the pressure in the outlet channel and a reference pressure influenced by a pressure in the refrigerant circuit and for the screw compressor to comprise a compressor control which switches off the drive for the at least one screw rotor when the difference in pressure following a starting phase of the drive is not in an operating pressure range determined by compression of the refrigerant.

The advantage of the solution according to the invention is to be seen in the fact that, as a result, it is possible to monitor whether the screw compressor is operating in the sense of a compression of the refrigerant and to switch the drive off should this not be the case, for example, when the drive is running with the wrong direction of rotation.

In this respect, it is advantageous for no absolute detection of the pressure in the outlet channel to take place but rather for the difference in pressure to be ascertained in relation to a reference pressure in the refrigerant circuit so that, as a result, there is no dependence on the absolute level of pressure in the outlet channel but rather the entire refrigerant circuit and, therefore, also the screw compressor can operate at different absolute levels of pressure.

In this respect, it is particularly favorable when the reference pressure is influenced by a pressure in the high pressure section of the refrigerant circuit so that, as a result, a reference pressure is present which is in the same order of magnitude as the pressure in the outlet channel and so the difference in pressure can be determined in a simple manner.

It is even better when the reference pressure is derived from a pressure in the high pressure section of the refrigerant circuit, is preferably proportional to it.

In principle, the reference pressure could be passed to the differential pressure detection element through a separate pressure line between the differential pressure detection element and the respective section of the refrigerant circuit.

A particularly simple solution does, however, provide for the reference pressure to be influenced by the pressure in the refrigerant circuit which acts on the lubricant reservoir and is transferred by the lubricant supply.

In principle, it would be conceivable to design the first differential pressure detection element completely independently of the valve in the lubricant supply.

One particularly favorable solution does, however, provide for the differential pressure detection element to comprise an actuating device for the valve in the lubricant supply as well as a sensor detecting actuating positions thereof.

As a result, the valve can be used directly for the purpose of reacting in accordance with the differential pressure and its positions can then be used for detecting the differential pressure.

For example, it would be conceivable to detect optional elements of the valve in their various actuating positions.

One particularly favorable solution does, however, provide for the sensor to detect piston positions of the actuating device.

The detection of piston positions may be brought about in the most varied of ways, for example, inductive sensors or sensors reacting to magnetic fields can be used for this purpose when the piston is provided with a magnet, the position of which is then detected by the sensor.

In conjunction with the embodiment described thus far and with the solution according to the invention, it has not been explained in detail how the starting phase is intended to be detected and determined.

It would, for example, be conceivable to determine the starting phase of the drive by means of the number of the rotations resulting after the drive has been switched on.

It is, however, particularly simple when the compressor control determines the starting phase of the drive by means of a window of time which defines a predetermined period of time after the drive has been switched on.

In this respect, the compressor control preferably operates such that it checks whether the operating pressure range is reached during the starting phase, i.e., that the compressor control must receive the signal indicating the operating pressure range at the latest when the starting phase terminates.

In the simplest case, the operating pressure range is defined by the fact that the valve has left its closing position.

Alternatively or in addition to the embodiments described thus far, an additional, advantageous embodiment provides for a second differential pressure detection element to be provided which detects a difference in pressure forming at the lubricant filter and for the compressor control to switch the drive off when the difference in pressure exceeds a threshold value.

The advantage of this solution is to be seen in the fact that, as a result, it may be monitored whether the screw compressor is adequately supplied with lubricant since the difference in pressure is representative for the flow of lubricant through the lubricant filter, wherein a smaller drop in pressure results at the lubricant filter and this is reflected in the difference in pressure.

A particularly simple solution provides for the differential pressure detection element to detect the pressure of the lubricant in the line system in front of a filter member and behind the filter member of the lubricant filter.

In the most favorable case, the differential pressure detection element is designed such that this comprises a piston which is acted upon, on the one hand, by lubricant prior to passing through the filter member and, on the other hand, by lubricant after passing through the filter member of the lubricant filter and, therefore, the piston is adjusted according to the difference in pressure.

In order to be able to detect the individual positions of the piston, it is preferably provided for the differential pressure detection element to comprise a sensor for detecting at least one position of the piston.

A particularly compact solution provides for the differential pressure detection element to be integrated into the compressor housing, i.e., to be mounted on this such that it represents part of an overall housing for the screw compressor.

Additional features and advantages of the invention are the subject matter of the following description as well as the drawings illustrating one embodiment.

DETAILED DESCRIPTION OF THE INVENTION

Figure 1:
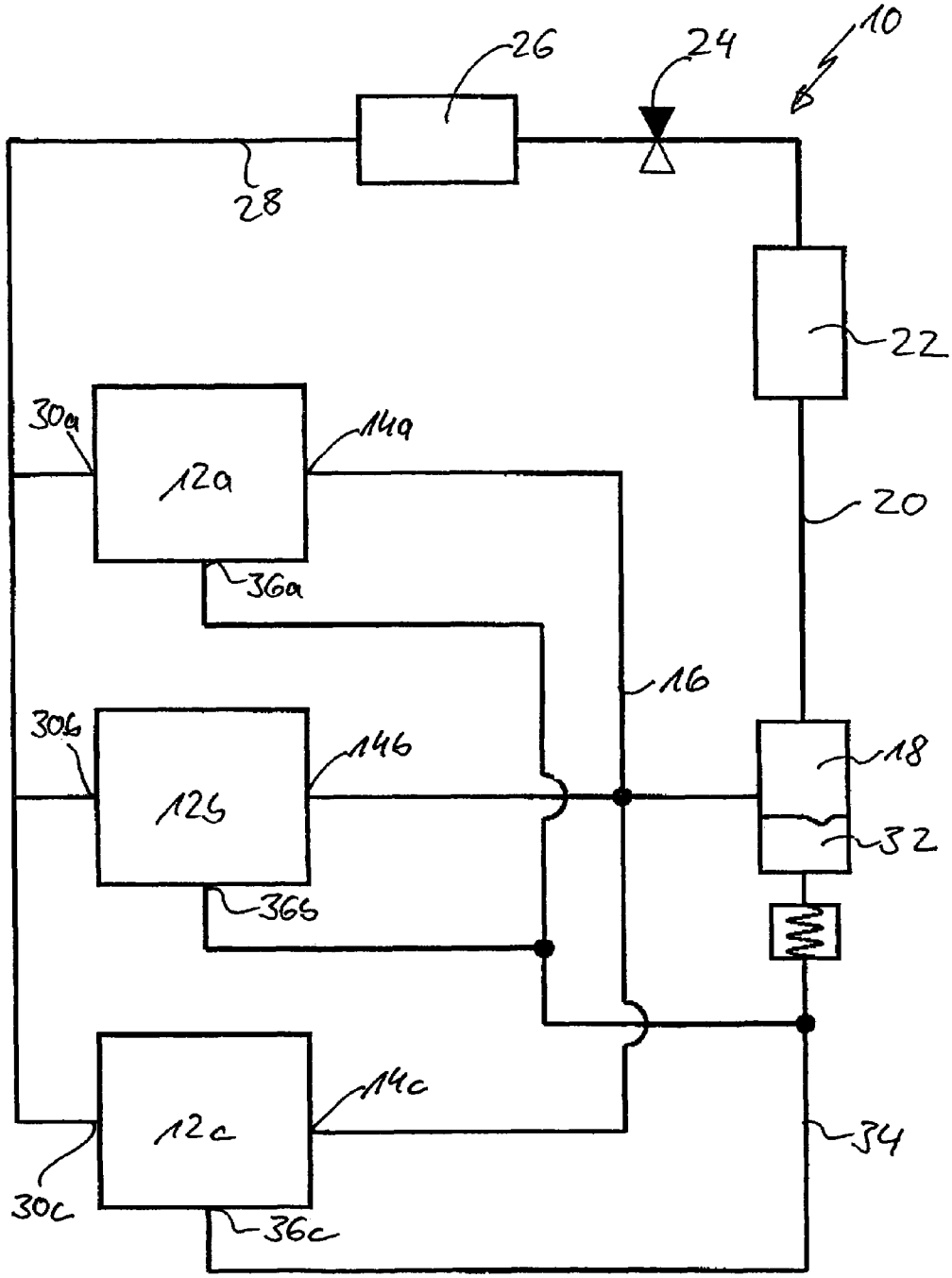
FIG. 1 shows a schematic illustration of a refrigerant circuit according to the invention with several compressors.

One embodiment of a refrigerant circuit according to the invention, designated in FIG. 1 as a whole as 10, comprises several compressors 12*a* to 12*c* connected in parallel, the high pressure connections 14*a* to 14*c* of which are connected to a high pressure line system 16 which leads into a lubricant separator which is designated as a whole as 18 and in which lubricant is separated from the refrigerant which is compressed and subject to high pressure.

A high pressure line 20 leads from the lubricant separator 18 through a heat exchanger 22 which cools the compressed refrigerant and then to an expansion valve 24 which serves the purpose of reducing the temperature of the refrigerant due to expansion thereof so that the expanded refrigerant has the possibility of releasing heat again in a heat exchanger 26.

In this respect, the expanded refrigerant is guided through a low pressure line 28 to low pressure connections 30*a* to *c* of the compressors 12*a* to *c*.

The compressors 12*a*, 12*b* and 12*c* are arranged in parallel in the refrigerant circuit 10 but can be switched on or off individually depending on the refrigerating capacity required.

Furthermore, a supply of lubricant to the compressors 12*a*, 12*b* and 12*c* connected in parallel is brought about from a lubricant reservoir 30 forming in the lubricant separator 18 and an external line system 34 which proceeds from the lubricant reservoir and leads to a lubricant supply connection 36*a*, 36*b* and 36*c* of the respective compressor 12*a* to 12*c*.

Figure 2:
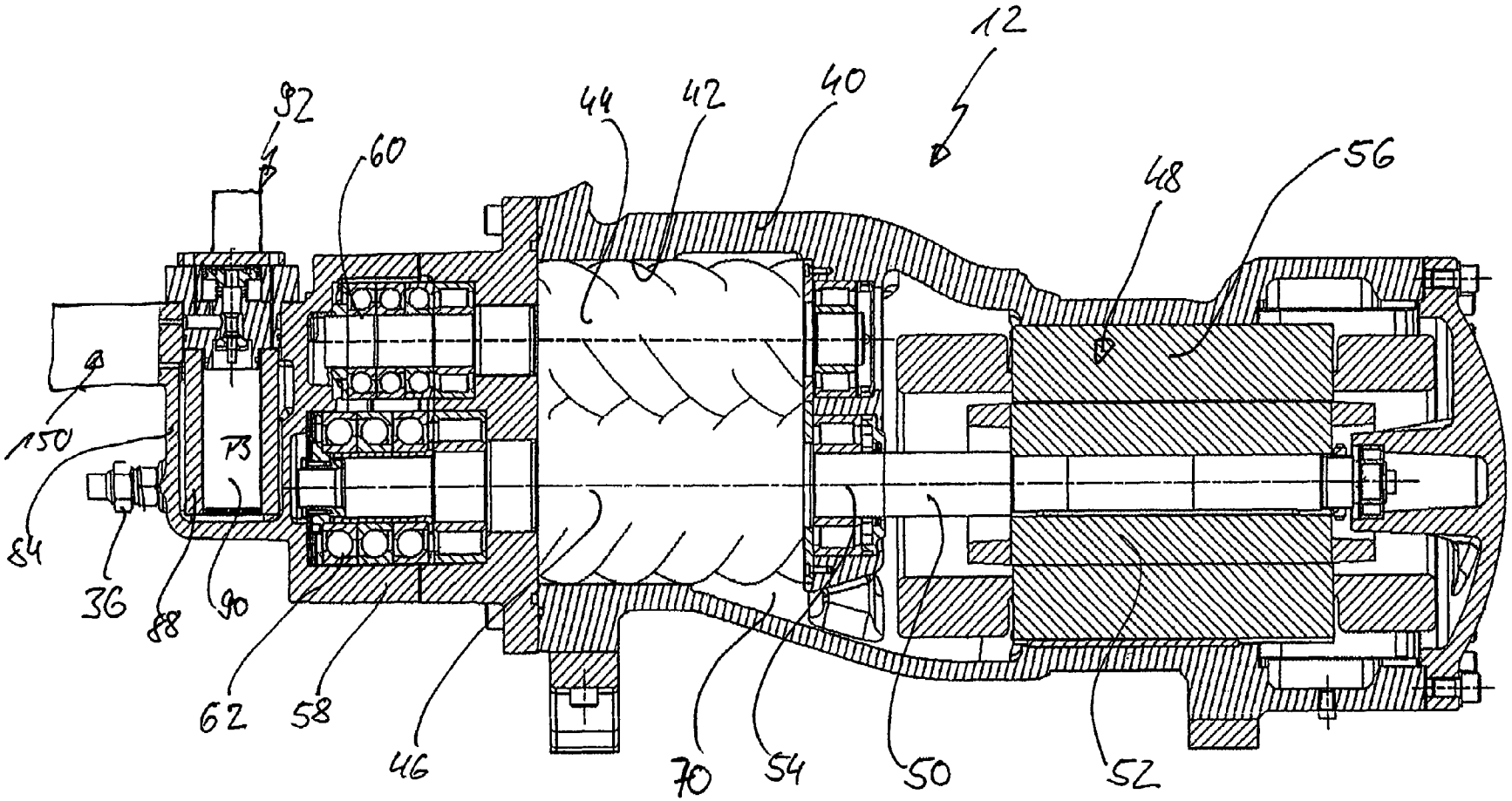
FIG. 2 shows a longitudinal section through one embodiment of a compressor according to the invention used in the refrigerant circuit according to FIG. 1.

One example of a compressor 12 of this type is illustrated in FIG. 2 and comprises a compressor housing 40, in which a screw rotor receiving means 42 is provided, for example, in the form of two screw rotor bores and serves to accommodate two interacting screw rotors 44, 46.

The screw rotors 44, 46 engage in one another in order to compress the refrigerant, wherein one of the screw rotors, for example, the screw rotor 46 is driven by a drive motor which is designated as a whole as 48 and is likewise arranged in the compressor housing 40.

The drive motor 48 drives a drive shaft 50, on which the screw rotor 46 as well as a rotor 52 of the drive motor are seated and which is mounted in the compressor housing 40 so as to be rotatable about a rotor axis 54.

The rotor 52 of the drive motor 48 is driven as a result of the interaction with a stator 56 likewise arranged in the compressor housing 42.

The screw compressor is preferably constructed, in principle, like that described in the European patent application WO 02/053917, to which reference is made in full in this respect.

On a side located opposite the drive motor 48, the compressor housing 40 comprises a bearing housing 58, in which bearing units 60 and 62 are arranged for the mounting of the screw rotors 44, 46.

Figure 3:
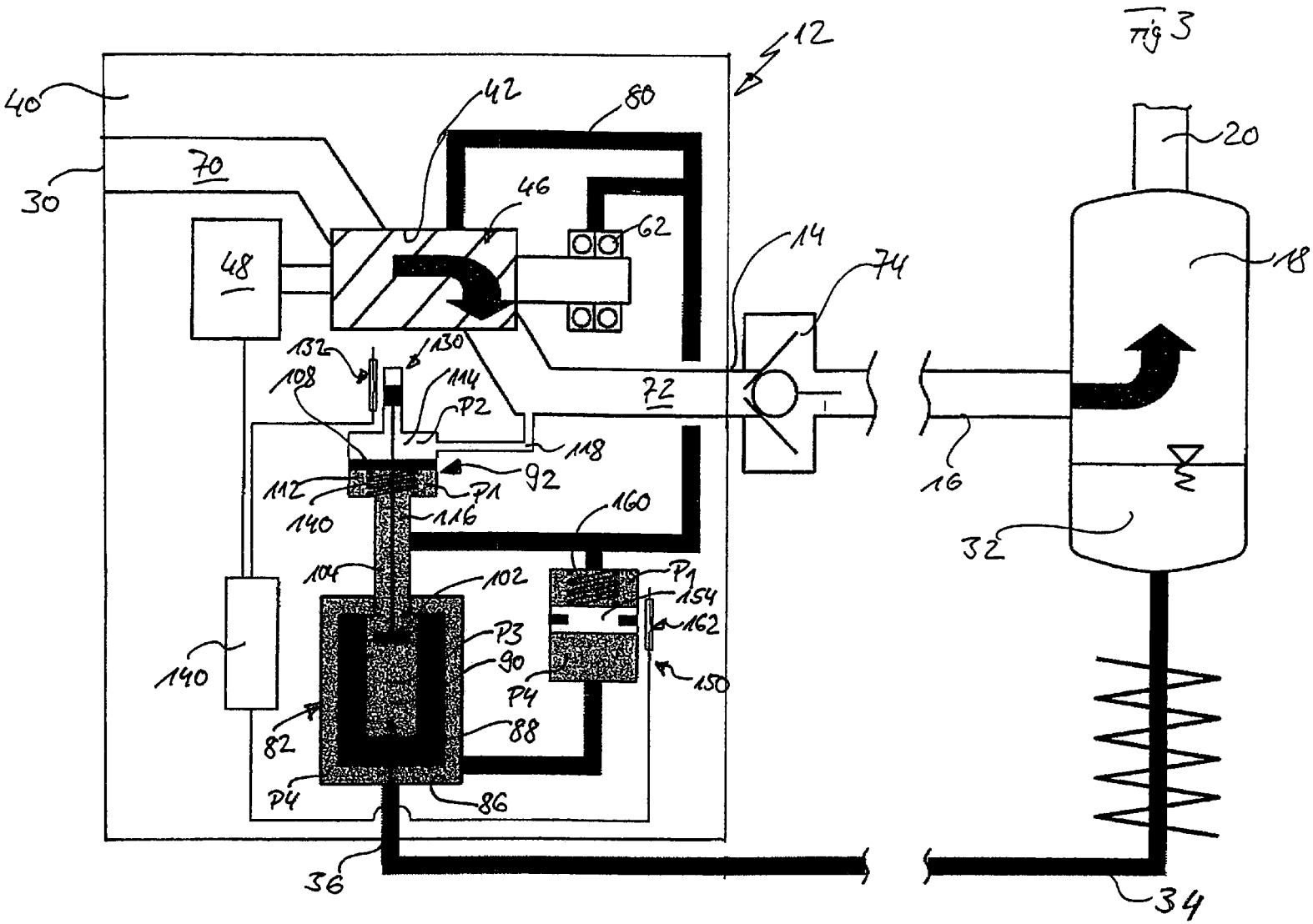
FIG. 3 shows a schematized illustration of the compressor in FIG. 2 with various components thereof in interaction with a lubricant reservoir in the refrigerant circuit.

A screw compressor of this type is again illustrated in FIG. 3 in a schematized manner, wherein for reasons of simplicity the drive motor 48 and only one screw rotor, namely the screw rotor 46, are illustrated in their schematized arrangement in the compressor housing likewise illustrated in a schematized manner.

Furthermore, as illustrated in FIGS. 2 and 3, an inlet channel 70 leads to the screw rotors 44 and 46 and, in addition, as illustrated in FIG. 3, an outlet channel 72 is provided in the compressor housing 40 and this guides the compressed refrigerant to the high pressure connection 14, following which a return valve 74 is arranged, by means of which the compressed refrigerant enters the high pressure line system 16 and is then guided to the lubricant separator 18.

An internal lubricant line system 80 is provided in the compressor housing 14 itself and, proceeding from the lubricant supply connection 36, this supplies lubricant filtered through a lubricant filter 82 to the bearings 60, 62 for the screw rotors, on the one hand, and to the screw rotors 44, 46, on the other hand, in order to lubricate them during running. In addition, the device can be supplied with lubricant which is subject to pressure in order to regulate the capacity of the screw compressor.

Figure 4:
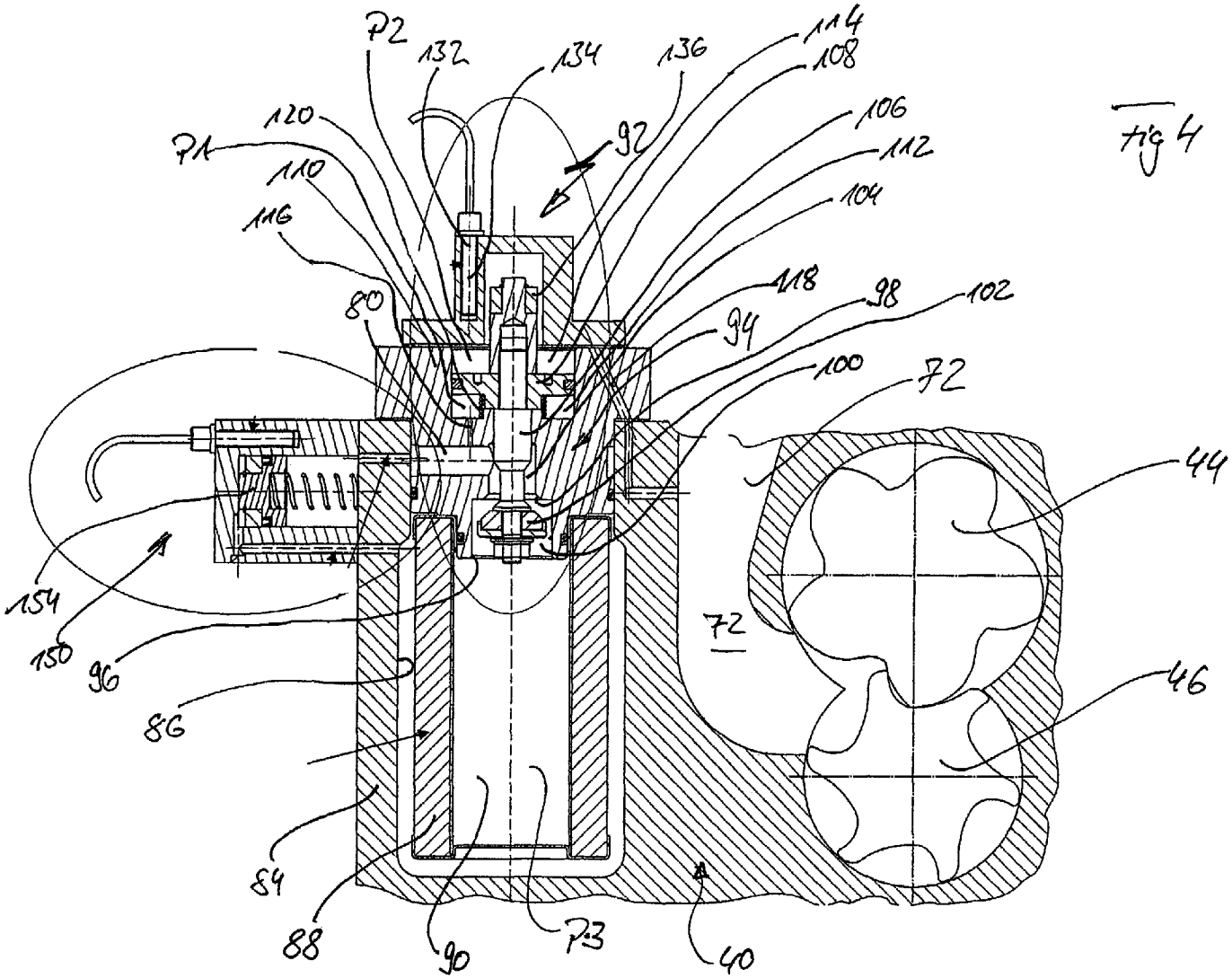
FIG. 4 shows a sectional illustration of a partial area of a compressor housing with a section through a lubricant filter, a valve in the lubricant supply and a first differential pressure detection element and a second differential pressure detection element which are all integrated into the compressor housing in an opened position of the valve, a position of the first differential pressure detection element moved out of the closing position and a position of the second differential pressure detection element indicating a correct flow of lubricant.

The internal lubricant line system 80 may, however, also lead to additional bearings of the screw rotors 44, 46 and of the drive motor 48. The lubricant filter is, as illustrated in FIGS. 2, 3 and 4, formed by a filter housing 84 which is integrated into the compressor housing 40 and into the interior 86 of which a filter member 88 is inserted which filters lubricant entering the interior 86 and guides the filtered lubricant via a chamber 90 enclosed by the filter member 88 to a lubricant stop valve which is designated as a whole as 92 and is integrated into a cover member 94 of the filter housing 84 and, therefore, also into the compressor housing 40.

The cover member 94 comprises an entry opening 96 for the lubricant which is open towards the chamber 90 and to which a chamber 100 for accommodating a valve member 102 of the lubricant stop valve 92 is connected, this chamber leading to a valve seat 98.

On a side of the valve seat 98 located opposite the chamber 100, an outflow channel 104 is provided for the filtered lubricant flowing through the valve seat 98, wherein the additional, internal lubricant line system 80 continues from the outflow chamber 104.

A valve plunger 106 bearing the valve member 102 also passes through the outflow chamber 104 and this plunger leads from the valve member 102 to a valve piston 108 which separates from one another two cylinder chambers 112 and 114 arranged in a cylinder housing 110, wherein the cylinder housing 110 is likewise integrated into the cover member 94 of the valve housing 84.

The cylinder chamber 112 is located on a side facing the valve member 102 and is connected to the outflow channel 104 of the internal lubricant line system 80 via a branch channel 116 so that the piston 108 can be acted upon by lubricant present in the cylinder chamber 112 at a pressure P1.

The cylinder chamber 114 is connected to the outlet channel 72 of the screw compressor 12 via a channel 118 guided in the compressor housing 40 so that the piston 108 can be acted upon, on the other hand, by refrigerant which is subject to the pressure P2 in the outlet channel 72.

In addition, a spring 120 acting on the piston 108 is also provided in the cylinder housing 110 and this spring acts on the piston 108 in the direction of a closing position, in which the piston 108 sees to it that the valve member 102 rests sealingly on the valve seat 98 and keeps the valve closed, in particular, in the case of a balance of pressure at the piston 108.

The opening and closing of the lubricant stop valve 92 is therefore brought about by movement of the piston 108 in accordance with the difference in pressure between the pressure P1 in the cylinder chamber 112 and the pressure P2 in the cylinder chamber 114.

If the pressure P2 in the cylinder chamber 114 is higher than the pressure P1 in the cylinder chamber 112, the lubricant stop valve opens due to the fact that the piston 108 is moved into the opening position contrary to the force of the spring 120 and therefore causes the valve member 102 to lift away from the valve seat 98 and so lubricant from the chamber 90 can enter the outflow channel 104 and, from there, the internal lubricant line system 80 which leads further on.

This state is reached when the screw compressor is operating, i.e., the two screw rotors 44 and 46 are compressing the refrigerant in such a manner that refrigerant compressed to high pressure P2 is present in the outlet channel 72 and so the pressure P2 in the cylinder chamber 114 corresponds to the refrigerant compressed to high pressure.

Since the effective cross sectional area of the piston 108 limiting the cylinder chamber 114 is greater than the effective cross sectional area of the valve member 102, which is seated on the valve seat 98 and on which the pressure P3 of the lubricant in the chamber 90 acts in the closing position, the high pressure P2 generated in the outlet channel 72 during refrigerant compression results in the piston 108 lifting the valve member 92 away from the valve seat 98 and, therefore, transferring into its opened position illustrated in FIG. 4.

As a result, a lubricant supply to the screw compressor results via the internal lubricant line system 80 with the lubricant collecting in the chamber 90 of the filter member 88 and subject to the pressure P3 which is approximately proportional to a pressure in the high pressure line system 16 and, therefore, to the pressure in the lubricant separator 18.

Figure 5:
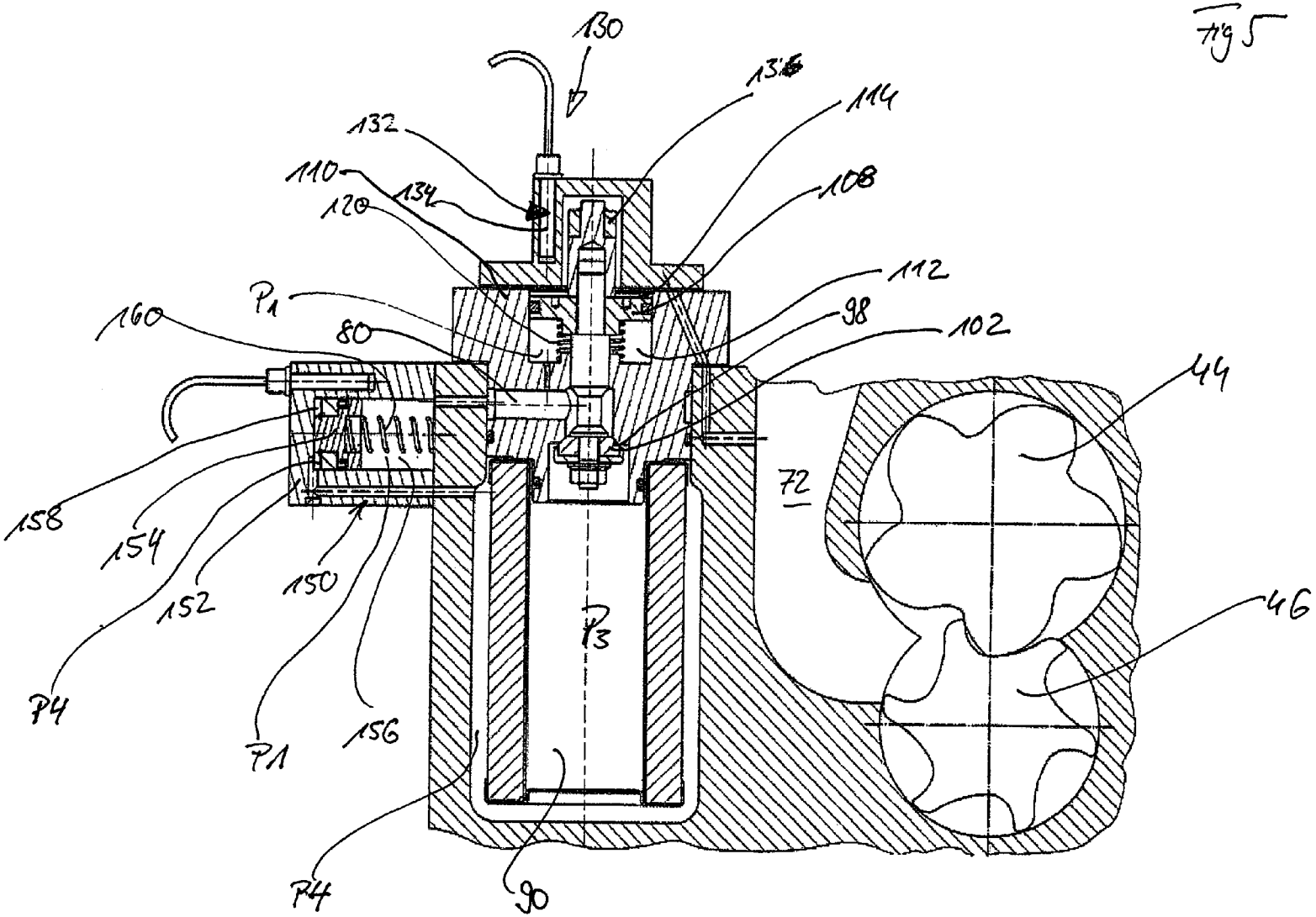
FIG. 5 shows a section similar to FIG. 4 with a closed position of the valve with a first differential pressure detection element in a closing position and a second differential pressure detection element still indicating a correct flow of lubricant immediately after closure of the valve.
Figure 6:
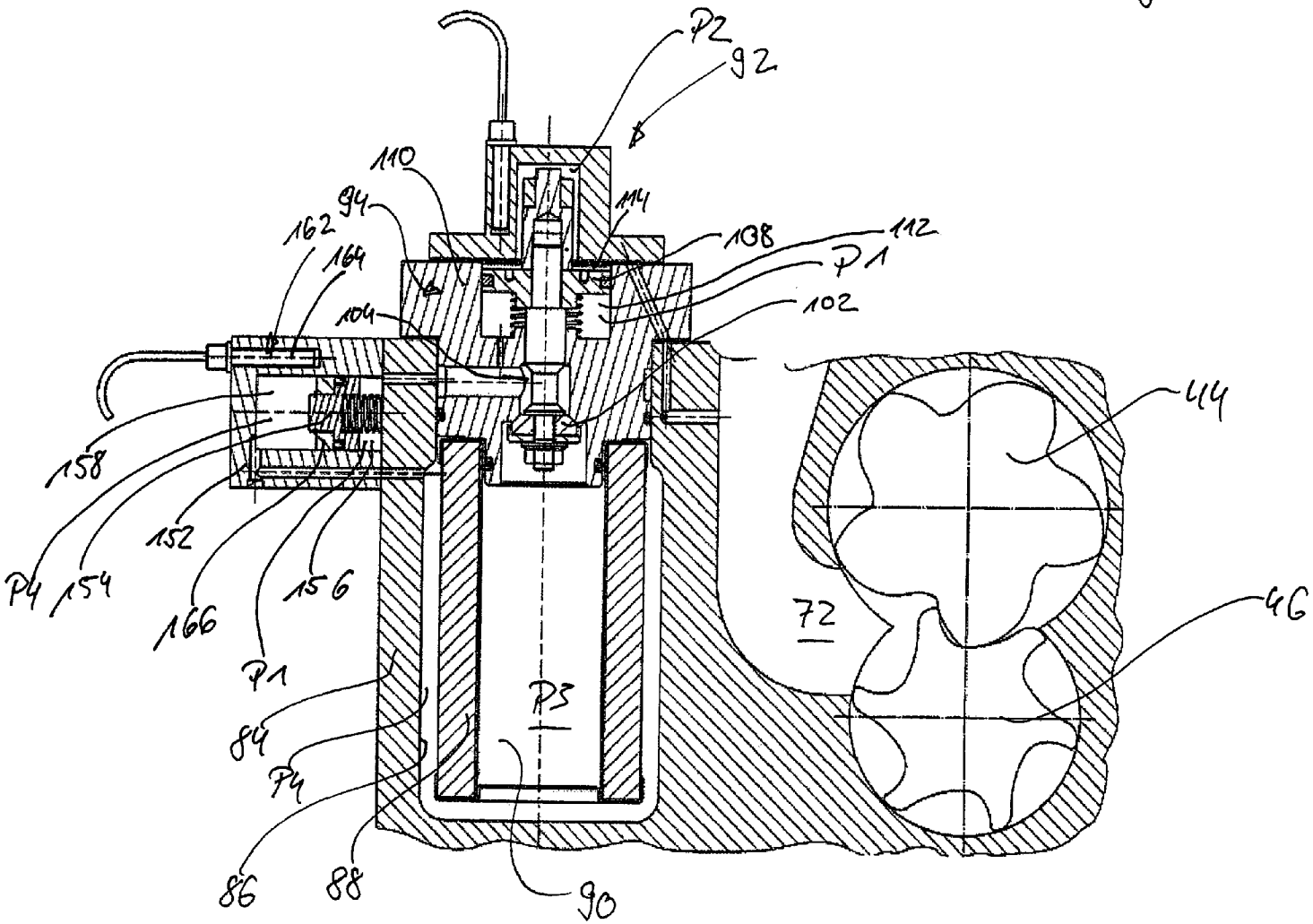
FIG. 6 shows a section similar to FIG. 4 with a valve in the closed position, a first differential pressure detection element in a closing position and a second differential pressure detection element indicating a not correct flow of lubricant

If the drive 48 and, therefore, the screw rotors 44 and 46, as well, are brought to a standstill, the pressure of the compressed refrigerant in the outlet channel 72 collapses and, therefore, the pressure P2 in the cylinder chamber 114 also drops. This leads to the pressure P1 in the cylinder chamber 112 moving the piston 108 in the direction of its closing position which is illustrated in FIG. 5.

In this closing position, the pressure P1 in the cylinder chamber 112 also collapses but, on the other hand, the pressure P3 in the chamber 90, which acts on the valve member 102, causes the valve member 102 to remain in its position seated on the valve seat 98 and, therefore, to interrupt the supply to the additional, internal lubricant line system 80 with lubricant from the chamber 90 so that, as a result, lubricant is prevented from constantly running on from the lubricant reservoir 32 and, therefore, from collecting in the screw compressor, for example, the screw rotor receiving means 42 thereof.

The lubricant stop valve 92 does, however, have not only the task of interrupting the flow of lubricant from the chamber 90 of the lubricant filter 82 into the additional, internal lubricant line system 80 when the drive motor 48 is switched off and, therefore, the movement of the screw rotors 44 and 46 stopped but it is, in addition, part of a first element 130 for detecting a difference in pressure which comprises, in addition, a position sensor 132 for the positions of the piston 108.

The position sensor 132 is formed, for example, by a so-called reed relay 134 and a magnetic member 136 which triggers the reed relay and is, for its part, moved together with the piston 108 in the cylinder housing 110.

As soon as the magnet 136 is at the level of the reed relay 134, this triggers a contact and so the position sensor 132, in the case of its corresponding arrangement close to the closing position of the piston 108, for example, is in a position to detect the piston 108 in this closing position.

In addition, it is also possible to detect whether the piston 108 has left the closing position and, therefore, the valve member 102 has lifted away from the valve seat 98 and releases the supply of lubricant to the additional, internal lubricant line system 80, as illustrated in FIG. 4.

The signal of the position sensor 132 is transmitted to a compressor control 140, with which the drive motor 48 can also be controlled.

The differential pressure detection element 130 creates not only the possibility for the compressor control 140 to recognize whether the lubricant stop valve 92 has opened but also the possibility of recognizing whether the screw rotors 44, 46 are being driven by the drive motor 48 in the correct direction of rotation and, therefore, build up the required pressure P2 in the outlet channel 72. When the screw rotors 44, 46 are rotating in the wrong direction, no pressure will be built up in the outlet channel.

In accordance with the invention, this pressure in the outlet channel, which corresponds to the pressure P2 in the cylinder chamber 112, is not detected absolutely but rather in relation to the reference pressures P1 and P3 which are influenced by the pressure in the high pressure section 16, 20 of the refrigerant circuit 10, in particular, the pressure in the lubricant separator 18, are preferably proportional to this pressure.

As a result, it is possible with the first differential pressure detection element 130 to determine whether the pressure P2 in the outlet channel 72 is greater than the pressures P1 and P3 and, therefore, to determine whether the pressure P2 is so great that refrigerant compressed to high pressure is being conveyed through the return valve 74 into the high pressure line system 16.

In this case, it is to be assumed that the screw rotors 44 and 46 are rotating in the correct direction and, therefore, damage due to a wrong direction of rotation of the screw rotors 44, 46 can be prevented.

The compressor control 140 is preferably configured such that within a window of time following the switching on of the drive motor 148 the position sensor 132 monitors and checks whether the piston 108 has left the closing position.

The window of time is set, for example, such that it lasts at the most one second. The window of time may, however, also be of a shorter duration, for example, half a second.

If the compressor control 140 recognizes within the window of time that the piston 108 has not left the closing position, the compressor control 140 will assume that the screw rotors 44, 46 are either rotating in the wrong direction or other damage is present which results in the drive motor 48 being switched off.

In addition to the first differential pressure detection element 130, which primarily detects the faultless functioning of the screw rotors 44, 46 after the drive motor 48 has started up, a second differential pressure detection element 150 is provided which, as illustrated in FIGS. 4 to 7, comprises a cylinder housing 152, in which a piston 154 is provided which separates a first cylinder chamber 156 from a second cylinder chamber 158 which are arranged on opposite sides of the piston 154.

The first cylinder chamber 156 is acted upon by the pressure P1 which also corresponds approximately to the pressure in the first cylinder chamber 112 whereas the second cylinder chamber 158 is acted upon by a pressure P4 which corresponds to the pressure of the lubricant in the interior 86 of the filter housing 84 prior to it passing through the filter member 88.

The piston 154 now moves in accordance with the difference in the pressures P1 and P4, wherein the piston 154 is acted upon, in addition, in the direction of its end position corresponding to the correct flow of lubricant and illustrated in FIGS. 4 and 5, i.e., the sum of the forces exerted on the piston 154 due to the spring 160 and the pressure P1 is greater than the force exerted on the piston 154 by the pressure P4.

This position of the piston 154 indicating the correct flow of lubricant is taken up when the valve member 102 is lifted away from the valve seat 98 and, therefore, the pressure P1 acts on the piston 154; however, on the other hand, the pressure P4 in front of the filter cartridge 88 is not substantially greater than the pressure P1 which is the case when the filter cartridge 88 for the lubricant is not clogged by dirt (FIG. 4).

The position of the piston 154 indicating the correct flow of lubricant is, therefore, dependent on a faultless functioning of the filter cartridge 88 and, in addition, is also dependent on the fact that the lubricant stop valve 92 is actually opened.

If the lubricant stop valve 92 is closed, the piston 154 remains in its position indicating a correct flow of lubricant (FIG. 5) for as long as the pressure P1 has not collapsed and then transfers into the position indicating a not correct flow of lubricant (FIG. 6) when the pressure P4 is greater than the pressure P1.

Figure 7:
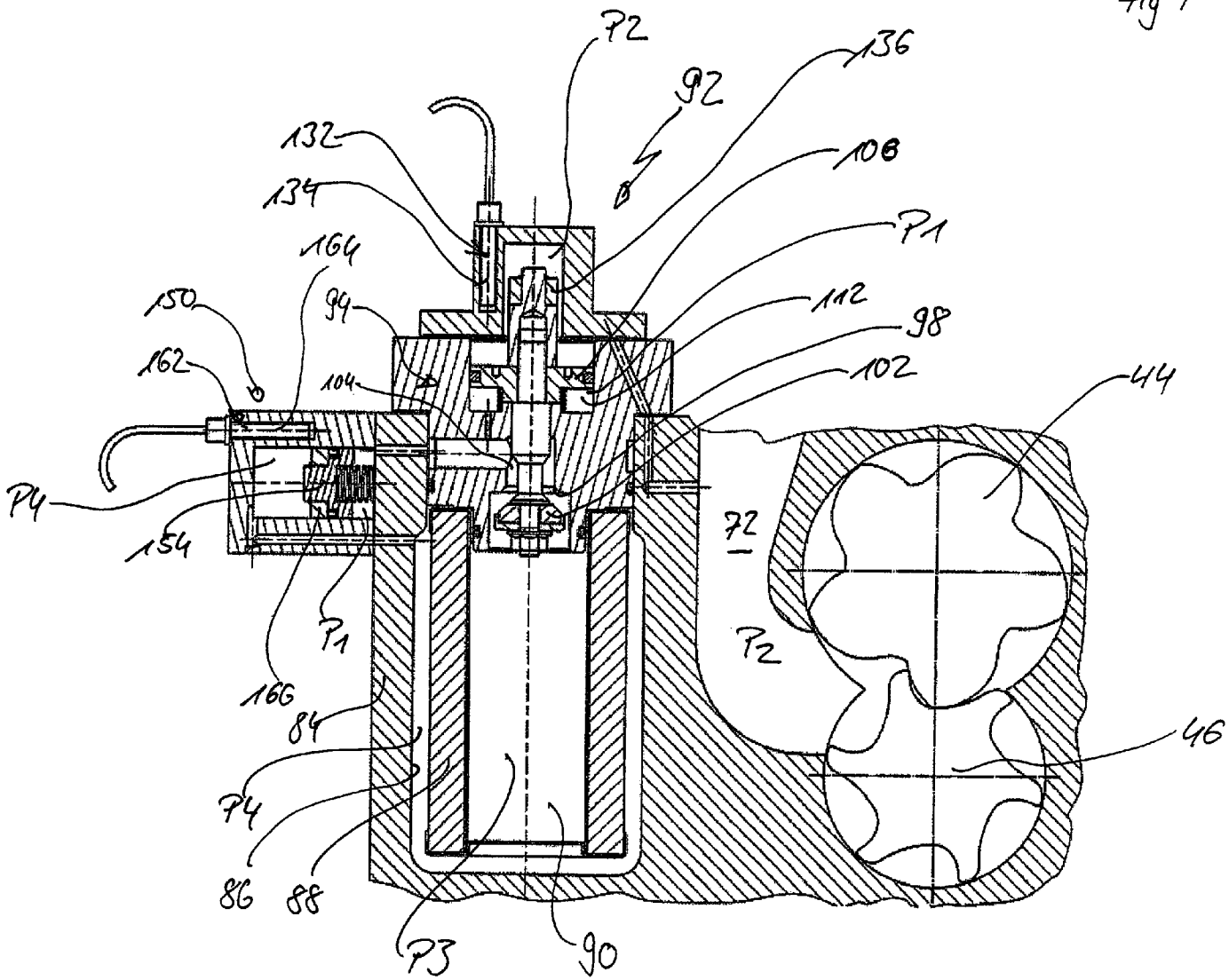
FIG. 7 shows a section similar to FIG. 4 with a valve in the opened position, a first differential pressure detection element moved out of the closed position and a differential pressure detection element indicating a not correct flow of lubricant.

If, on the other hand, the lubricant stop valve 92 is opened, as illustrated in FIG. 7, and the piston 154 is, nevertheless, not in its position indicating a correct flow of lubricant but in an opposite position, this means that the filter cartridge 88 is blocked and, therefore, too great a drop is pressure results at it.

As a result, it is possible with the second differential pressure detection element 150 to check and monitor the correct flow of lubricant partially redundant in relation to the lubricant stop valve 92.

This is brought about by means of a second position sensor 162 which is likewise designed as a reed contact 164 and detects the position of a magnet 166 taken along by the piston 154 when the piston 154 is in its position indicating the correct flow of oil.

The position sensor 162 is also connected to the compressor control 140 so that this is in a position, via the second differential pressure detection element 150, to check the correct flow of lubricant and, where applicable, to switch the drive motor off in the case of a not correct flow of lubricant in order to avoid damage on account of a lack of lubrication of the screw rotors 44, 46 or the bearings 60, 62.

The invention claimed is:

1. Screw compressor for compressing refrigerant in a refrigerant circuit, comprising a compressor housing, a screw rotor receiving means and an inlet channel as well as an outlet channel for the refrigerant to be compressed being provided in said housing, at least one screw rotor arranged in the screw rotor receiving means, a drive for the at least one screw rotor and a lubricant supply conveying lubricant from a lubricant reservoir acted upon by pressure via a line system to the at least one screw rotor during operation, said lubricant supply comprising a first differential pressure detection element detecting a difference in pressure between the pressure in the outlet channel and a reference pressure influenced by a pressure in the refrigerant circuit, the first differential compressor detection element comprising an actuating device for the valve in the lubricant supply as well as a sensor detecting actuation positions thereof, and a compressor control, said control switching off the drive for the at least one screw rotor when the difference in pressure following a starting phase of the drive is not in an operating pressure range determined by compression of the refrigerant as determined by the first differential compressor detection element.

2. Screw compressor as defined in claim 1, wherein the reference pressure is influenced by a pressure in the high pressure section of the refrigerant circuit.

3. Screw compressor as defined in claim 1, wherein the reference pressure is influenced by the pressure in the refrigerant circuit acting on the lubricant reservoir and transferred by the lubricant supply.

4. Screw compressor as defined in claim 1, wherein the sensor detects piston positions of the actuating device.

5. Screw compressor as defined in claim 1, wherein the compressor control determines the starting phase of the drive by means of a window of time.

6. Screw compressor as defined in claim 5, wherein the compressor control checks whether the operating pressure range is reached during the starting phase.

7. Screw compressor for compressing refrigerant in a refrigerant circuit, comprising a compressor housing, a screw rotor receiving means and an inlet channel as well as an outlet channel for the refrigerant to be compressed being provided in said housing, at least one screw rotor arranged in the screw rotor receiving means, a drive for the at least one screw rotor and a lubricant supply conveying lubricant from a lubricant reservoir acted upon by pressure via a line system to the at least one screw rotor during operation, a differential pressure detection element detecting a difference in pressure forming at the lubricant filter, the differential pressure detection element detecting the pressure of the lubricant in the line system in front of a filter member of the lubricant filter and behind the filter member of the lubricant filter, said differential pressure detection element comprising a piston, said piston being acted upon, on the one hand by lubricant prior to passing through a filter member of the lubricant filter and, on the other hand, by lubricant after passing through the filter member of the lubricant filter and a compressor control switching the drive off when the difference in pressure exceeds a threshold value.

8. Screw compressor as defined in claim 7, wherein the differential pressure detection element comprises a sensor for detecting at least one position of the piston.

9. Screw compressor as defined in claim 7, wherein the differential pressure detection element is integrated into the compressor housing.

* * * * *